United States Patent [19]

Eggert

[11] Patent Number: 4,767,454

[45] Date of Patent: Aug. 30, 1988

[54] PROCESS FOR THE PREPARATION OF FINELY PARTICULATE CHROMIUM METAL POWDER HAVING A LOW OXYGEN CONTENT

[75] Inventor: Horst Eggert, Essen, Fed. Rep. of Germany

[73] Assignee: Th. Goldschmidt AG, Essen, Fed. Rep. of Germany

[21] Appl. No.: 11,385

[22] Filed: Feb. 5, 1987

Related U.S. Application Data

[63] Continuation of Ser. No. 677,213, Dec. 3, 1984, abandoned.

[30] Foreign Application Priority Data

Dec. 6, 1983 [DE] Fed. Rep. of Germany ..... 3343989

[51] Int. Cl.[4] ..... C22B 34/32

[52] U.S. Cl. ..... 75/84

[58] Field of Search ..... 75/84, 27

[56] References Cited

U.S. PATENT DOCUMENTS 2,332,415 10/1943 Udy ..... 75/84

2,854,327 9/1958 Perrin et al. ..... 75/84

2,889,218 6/1959 Hiskey et al. ..... 75/27

3,053,649 9/1962 Galmiche ..... 75/84

3,623,861 8/1969 Arias ..... 75/27

FOREIGN PATENT DOCUMENTS 77548 5/1983 Japan .

*Primary Examiner*—John F. Terapane

*Assistant Examiner*—Eric Jorgensen

*Attorney, Agent, or Firm*—Toren, McGeady & Associates

[57] ABSTRACT

For preparing a chromium metal powder lacking in oxygen and having an average particle size not greater than 20 μm, a mixture of chromium oxide and calcium oxide, in a molar ratio of 1:0.5 to 1:2, is calcined initially at temperatures of 650° to 1,200° C. with access of oxygen up to a weight increase of 1 to 6 g per mole of chromium oxide, the calcined product is comminuted to a particle size not greater than 100 μm and the product so obtained is reduced calciothermally. The calcium oxide can be replaced wholly or partially by calcium carbonate.

29 Claims, 2 Drawing Sheets

PROCESS FOR THE PREPARATION OF FINELY PARTICULATE CHROMIUM METAL POWDER HAVING A LOW OXYGEN CONTENT

This is a continuation, of application Ser. No. 677,213, filed Dec. 3, 1984, now abandoned.

BACKGROUND OF THE INVENTION

1. Field of the Invention

The invention relates to a process for the preparation of chromium metal powders having a low oxygen content and an average particle size not greater than 20 μm by metallothermal reduction of a mixture of chromium oxide and calcium oxide with calcium metal in a reactor to which access of oxygen is prevented, at temperatures of 1,000 to 1,250° C. and an initial pressure of not greater than $10^{-3}$ bar at room temperature.

2. Description of the Prior Art

It has long been known that metal oxides, such as, for example, the oxides of uranium, zirconium, vanadium, titanium or chromium, can be reduced with alkaline earth metals, especially with calcium metal. For example, German patent No. 441,640 describes a process in which the oxide is heated with an alkaline earth metal, e.g., calcium, and a halide of the same or a different alkaline earth metal, e.g., calcium chloride or barium chloride, or an alkaline metal, for example, potassium chloride. However, the metal powder formed is relatively coarse grained and still contains relatively large amounts of oxygen. This oxygen content is attributable to the fact that unreduced metal oxide is enclosed in the coarse particles of metal powder.

German Auslegeschrift No. 10 30 033 relates to a process of the above type which is characterized by the fact that the reducing metal and the oxide to be reduced are introduced into a melt of alkali and alkaline earth halides, which melt has been dried by prolonged heating. This procedure does achieve a reduction in the unreduced metal oxide content. However, at best, a coarse-grained metal powder or metal regulus rather than a finely particulate metal powder is obtained.

German patent No. 935,456 discloses a process for the preparation of alloy powders by reducing metal compounds or mixtures of metal oxides with calcium. The addition of indifferent oxides to the reducing mixture is recommended in this patent. This addition is intended to prevent the melting of the alloy due to the strong evolution of heat during the reduction process or to prevent that the powder formed is very coarse. It has turned out, however, that although a chromium metal powder lower in oxygen can be obtained, this powder is still relatively coarse grained and has a particle size in excess of 100 μm.

Finally, a process for preparing titanium-based sinterable alloy powders by the calciothermal reduction of a mixture of the metal oxides of the metals forming the alloy is disclosed in Germany patent No. 30 17 782. This process is characterized by the following steps:

(a) titanium oxide is mixed with the other alloying components in amounts, based on the metals, corresponding to the desired alloy, alkaline earth oxide or alkaline earth carbonate is added in a 1 :1 to 6 :1 molar ratio of metal oxides, which are to be reduced, to alkaline earth oxide or carbonate, the mixture is homogenized, calcined for 6 to 18 hours at temperatures of 1,000 to 1,300° C., cooled and comminuted to a particulate size not greater than 1 mm;

(b) small pieces of calcium, in an amount equivalent to 1:1.2 to 1:2.0 of the oxygen content of the oxides to be reduced, as well as a booster, in a 1:0.01 to 1:0.2 molar ratio of oxide to booster, are added; this reaction formulation is mixed, the mixture is compressed into green compacts and filled into a reaction crucible which is then closed;

(c) the reaction crucible is transferred to a heated reaction furnace which can be evacuated, the reaction crucible is evacuated to an initial pressure of $1 \times 10^{-4}$ to $1 \times 10^{-6}$ bar and is heated for a period of 2 to 8 hours to a temperature of 1,000 to 1,300° C. and then cooled, whereupon the reaction product is removed from the reaction crucible and comminuted to a particle size not greater than 2 mm.

It is an important characteristic of the process of German patent No. 30 17 782 that instead of being reduced calciothermally, the mixtures of the metal oxides to be reduced are first calcined to a compound oxide system, the number of phases of which is smaller than the sum of the starting components. By means of this calcining process, it is possible to produce an alloy powder, the particles of which all have the same composition and structure.

SUMMARY OF THE INVENTION

I have discovered a method for producing a chromium metal powder which is lacking in oxygen and has an average particle size not greater than 20 μm. As far as possible, the oxygen content should be less than 0.1 weight percent. It is moreover of particular interest to produce a chromium metal powder having a particle size not greater than 10 μm, and especially one having a particle size not greater than 5 μm.

More particularly, the process of the present invention comprises calcining a 1:0.5 to 1:2 molar ratio mixture of $Cr_2O_3$ and CaO initially at temperatures of 650 to 1,200° C. with an access of oxygen up to a weight increase of 1 to 6 g per mole of $Cr_2O_3$, comminuting the calcined product to a particle size not greater than 100 μm and metallothermally reducing the product so obtained.

DESCRIPTION OF THE PREFERRED EMBODIMENTS

An important characteristic of the inventive process is that calcium oxide is mixed in a molar ratio of 1:0.5 to 1:2 with the chromium oxide to be reduced. However, in contrast to the teachings of German patent No. 935,456, this physical mixture of chromium oxide and calcium oxide is not reduced directly calciothermally. Rather, the mixture is first calcined in the presence of oxygen at temperatures of 650 to 1,200° C. until a weight increase of 1 to 6 g per mole of $Cr_2O_3$ can be detected. It is assumed that a portion of the mixture undergoes the following reaction during the calcining process:

$$2CaO + Cr_2O_3 + 1\tfrac{1}{2}O_2 = 2CaCrO_4.$$

If the reaction were to go to completion, a weight increase of 24 g per mole of $Cr_2O_3$ would be expected. A weight increase of 1 to 6 g per mole of chromium oxide therefore corresponds to a partial conversion of 4 to 25%. It has surprisingly turned out that the average particle size of the chromium metal powder becomes smaller as the weight increase, i.e., the degree of conversion, becomes larger.

Figure 1:
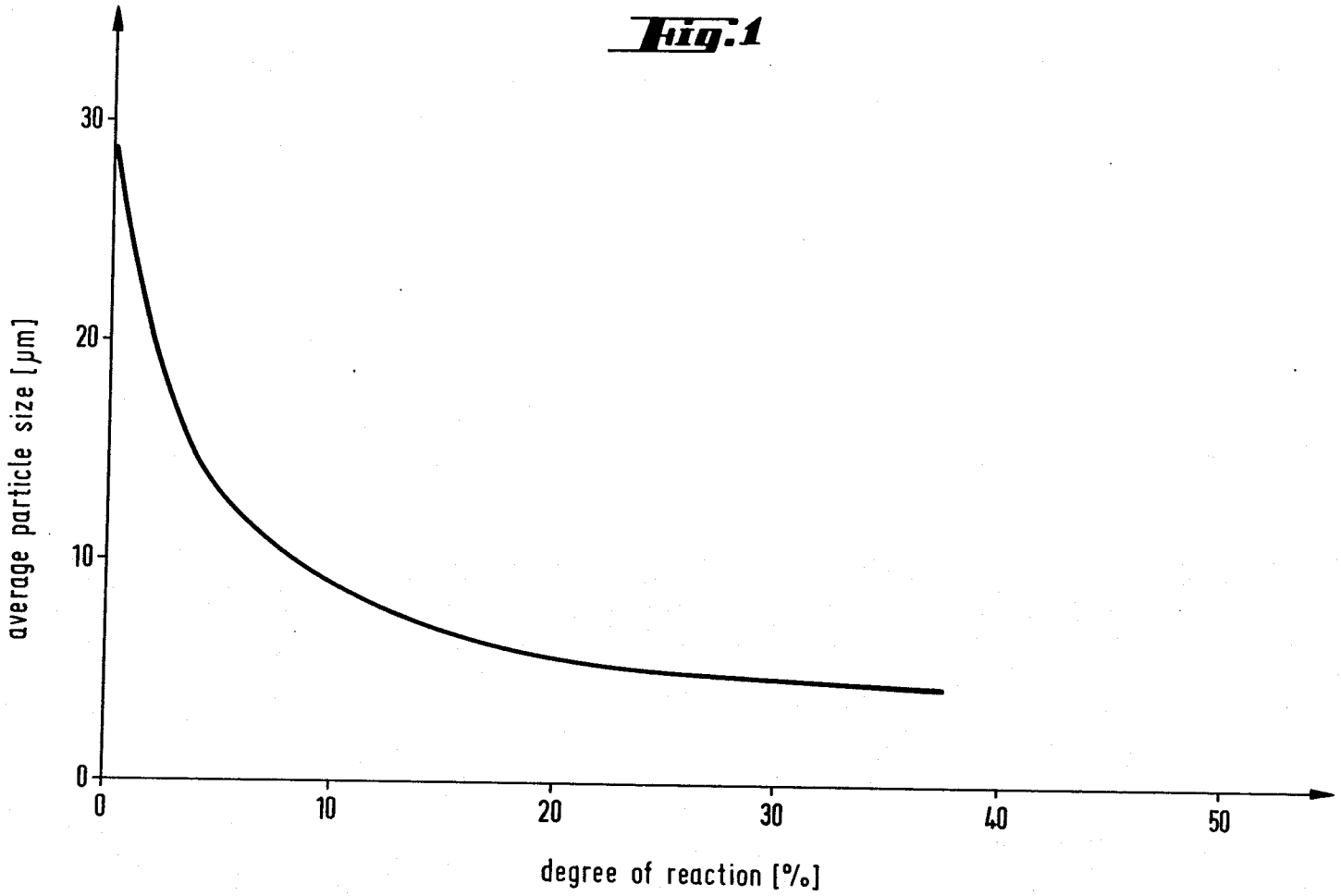
FIG. 1 is a graph showing the change in particle size with degree of conversion.

This functional relationship is shown in FIG. 1. Even at the relatively low degree of conversion of about 3 to 4%, the average particle size of the chromium metal powder attainable with the inventive process, falls from about 30 μm to 15 um. An average particle size of abut 5 μm is achieved at a conversion of about 25%. With further conversion, the particle size decreases slightly still further. Since, however, the trivalent chromium content of the calcined product decreases and the hexavalent chromium content increases with increasing conversion, correspondingly larger amounts of calcium are required for the calciothermal reduction of the product with the increased degree of conversion. For economic reasons, it is therefore not generally advisable to carry out the conversion to a higher degree than about 25%. In this respect, a weight increase of 6 g per mole of $Cr_2O_3$ is the recommended upper limit.

Since the reaction corresponding to the aforementioned equation proceeds with absorption of oxygen, the required duration of the calcining process depends on the calcining temperatures and on the equipment used.

Figure 2:
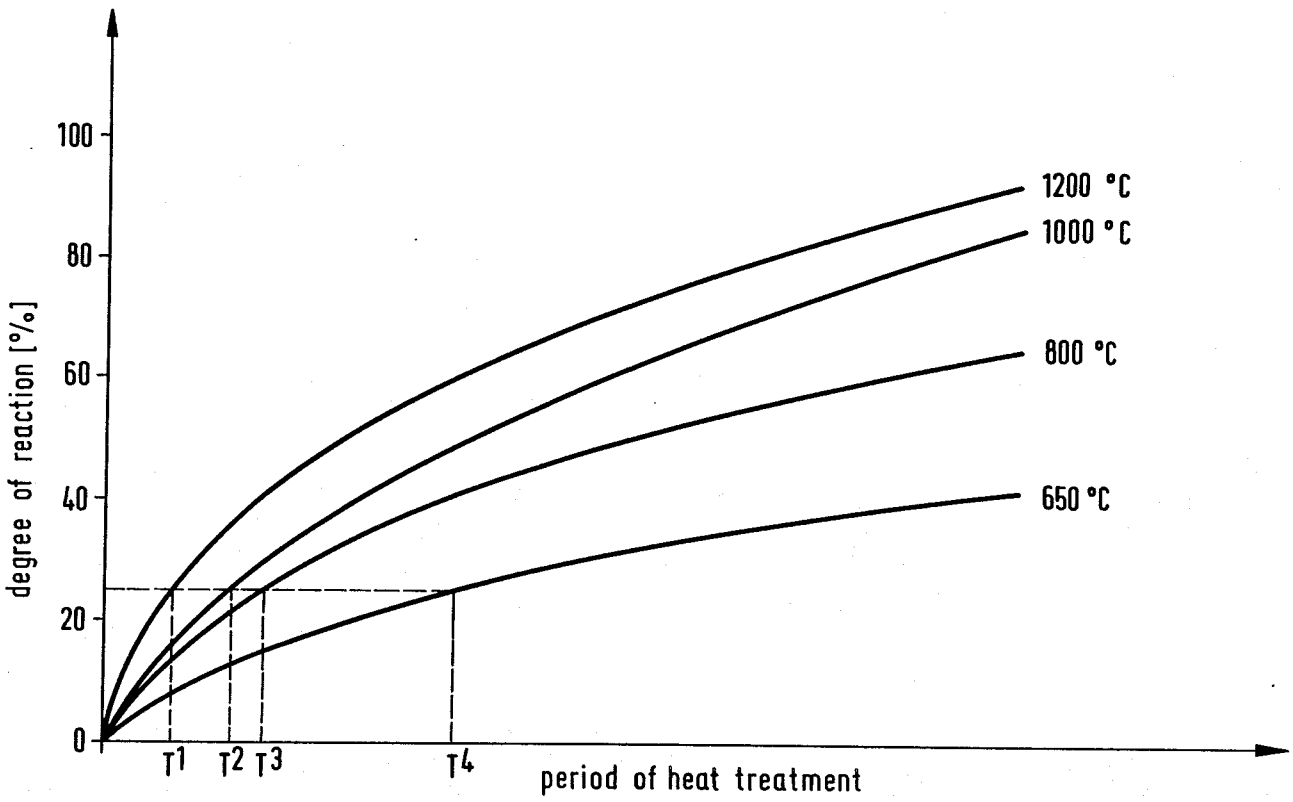
FIG. 2 is a graph showing the change in degree of conversion with duration of calcining at different temperatures.

FIG. 2 shows the duration of the calcining process as a function of temperature. The time spans required for a 25% conversion at calcining temperatures of 1,200° C., 1,000° C., 800° C. and 650° C. are labeled $T^1$, $T^2$, $T^3$ and $T^4$. The actual duration of the calcining process depends on various factors, such as, for example, the amount of available oxygen, the size of the accessible surface and the molar ratio of chromium oxide to calcium oxide. The duration of the calcining process is shortened by continuously rolling the calcined product over and by calcining the product in flowing air. In general, it has turned out that a calcining time of 2 to 48 hours must be employed depending on the conditions used.

In a modification of the inventive process, the calcium oxide can be replaced completely or partially by calcium carbonate. In this case, however, the calcining process must be carried out at temperatures of 1,000° to 1,200° C. in order to split off the carbon dioxide from the calcium carbonate. With this version of the process, a fresh, and therefore particularly reactive calcium oxide surface is formed during the calcining process. The fresh calcium oxide thus formed reacts quickly with chromium oxide and the oxygen of the air to form calcium chromate. Because carbon dioxide is split off, the weight increase of 6 g per mole of chromium oxide must then, of course, be related to a hypothetical starting mixture of $Cr_2O_3/CaO$ instead of to the actual mixture of $Cr_2O_3/CaCO_3$ or $Cr_2O_3/CaO+CaCO_3$.

It has turned out that the molar ratio of chromium oxide to calcium oxide (or calcium carbonate) should be 1:0.5 to 1:2. In view of the aforementioned reaction equation, a ratio of $1:<0.5$ is inappropriate. A molar ratio of $1:>2$ leads to unfavorable space-time yields per charge.

The calcium chromate in the inventively calcined mixture of chromium oxide and calcium oxide can be detected by X-ray diffraction. It is therefore clear to those skilled in the art that weight increase is only one measure of the degree of oxidation and that other analytical data, which permit the degree of oxidation to be determined, can be used instead.

After it has cooled, the inventively obtained calcined product is comminuted to a particle size not larger than 100 μm. If the particle size is significantly larger and calcined products having a particle size of, for example, 180 to 200 μm after milling, are reduced, a chromium metal powder with portion of undesirable coaese particle is obtained.

The calcined product, milled to a particle size not larger than 100 μm is now homogeneously mixed with, in relation to the chromium and its average oxidation state, at least equivalent amounts of calcuim metal in the form of calcium shavings. It is preferable to pelletize this mixture or to compress it into green compacts and to reduce the pellets or green compacts in a chromium crucible at a temperature of 1,000 to 1,250° C. In so doing, it is advis able to first evacuate the crucible to a pressure of not greater than $10^{-3}$ bar. During the reaction, the vapor pressure of the calcium according to the temperature is reached.

After the reaction, the reaction product is coarsely comminuted. The calcium oxide contained in the reaction product is subsequently leached out by dilute acids or complexing agents and the metal powder obtained is washed and dried.

The chromium metal powder obtained by the inventive process has a low oxygen content of 0.1 weight percent or less and is very finely particulate, the average particle size being not greater than 20 μm. Those skilled in the art will understand that the surface area of the chromium powder will increase with decreasing particle size and that therefore, the content of oxygen, bound to the surface of the chromium powder, can increase once again.

The following Example 1 is not according to the present invention and describes the preparation of a chromium metal powder from a mixture of chromium and calcium oxide. Example 2 is according to the invention and shows the preparation of a chromium metal powder of the desired fineness.

EXAMPLE 1

(not according to the invention)

Chromium oxide (1519.92 g) and 448.64 g calcium oxide are mixed homogeneously with 1563.1 g of calcium and, without further thermal or physical treatment, are compressed to green compacts having a diameter of 30 mm and a height of 30 mm. These green compacts are reduced for 2 hours in a chromium crucible at a temperature of 1,200° C. After the reduction, they are comminuted to a particle size not greater than 2 mm. The product of the reduction process is leached with dilute nitric acid and the metal powder obtained is dried in a vacuum.

The yield of metal powder is 1014 g=97.5%, based on the theoretical yield.

The metal powder obtained has a powder density of 44.5% and a tap density of 4.3 g/cc=59.8% of the theoretical density.

The Fisher average particle size is 29 μm.

The particle size distribution has the following values:

| | | | | | | | | | | |
|---|---|---|---|---|---|---|---|---|---|---|
| >500 | 500 | 355 | 250 | 180 | 125 | 90 | 63 | 45 | 32 | <25 μm |
| | 355 | 250 | 180 | 125 | 90 | 63 | 45 | 32 | 25 | |
| 0.2 | 1.8 | 4.0 | 4.4 | 10.0 | 6.0 | 11.4 | 12.6 | 7.4 | 10.6 | 31.6% |

| | | | |
|---|---|---|---|
| Fe | <0.05% | Sn | <0.01% |
| Co | <0.01% | Pd | <0.01% |
| Cu | <0.05% | P | <0.01% |
| Ni | <0.01% | S | <0.01% |
| Si | <0.05% | C | 0.04% |
| Mn | <0.05% | H | 0.001% |
| Al | 0.04% | N | 0.0025% |
| Ca | 0.02% | O | 0.03% |

Metallographic examination reveals a globular metal powder.

EXAMPLE 2

(according to the invention)

Chromium oxide (1519.92 g) and 1000.8 g of $CaCO_3$ are premixed homogeneously and calcined for 16 hours at 1,200° C. up to a weight increase of 42 g. The calcined mixed oxide is comminuted in a hammer mill to a particulate size less than 90 μm and has the following particle size distribution:

| | | | | | |
|---|---|---|---|---|---|
| >90 | 90 | 63 | 45 | 32 | <25 μm |
| | 63 | 45 | 32 | 25 | |
| 0.2 | 1.5 | 3.7 | 4.9 | 14.4 | 75.3% |

The powder density of the calcined mixed oxide is approximately 1.1 g/cc and the tap density is about 2.3 g/cc.

This mixed oxide (1,000 g) is mixed homogeneously with 751.3 g of calcium and compressed to green compacts with a diameter of 30 mm and a height of 30 mm. As in Example 1, the green compacts are filled into a chromium crucible for the reduction process. The reduction is carried out over a period of 8 hours at 1,150° C. After the reaction product has cooled down to room temperature, it is comminuted to a particle size not greater than 2 mm and leached with dilute nitric acid. The chromium metal powder obtained is then dried under vacuum.

The yield of metal powder is 479.8 g=96% based on the theoretical yield.

The dried chromium powder has a powder density of 3.2 g/cc=44.5% and a tap density of 4.3 g/cc=59.8% of the theoretical density.

The particle size distribution has the following values:

| | | | | | | |
|---|---|---|---|---|---|---|
| >125 | 125 | 90 | 63 | 45 | 32 | <25 μm |
| | 90 | 63 | 45 | 32 | 25 | |
| 0.1 | 0.2 | 2.8 | 3.6 | 4.0 | 4.8 | 84.5% |

The Fisher average particle size is 6.5 μm.

Chemical analysis of the chromium powder showed the following impurities to be present:

| | | | |
|---|---|---|---|
| Fe | <0.05% | Sn | <0.01% |
| Co | <0.01% | Pd | <0.01% |
| Cu | <0.05% | P | <0.01% |
| Ni | <0.01% | S | <0.01% |
| Si | <0.05% | C | 0.04% |

-continued

| | | | |
|---|---|---|---|
| Mn | <0.05% | H | 0.001% |
| Al | 0.05% | N | 0.003% |
| Ca | 0.04% | O | 0.09% |

Metallographic examination revealed a fine, spherical metal powder grain.

I claim:

1. A process for the preparation of a chromium metal powder having a low oxygen content of ≦ 0.1% by weight and an average particle size not greater than 20 μm, comprising calcining a mixture of chromium oxide and calcium oxide in a molar ratio of 1:0.5 to 1:2 at temperatures from 650 to 1,200° C., in the presence of oxygen up to a weight increase of 1 to 6 g of oxygen per mole of chromium oxide, comminuting the calcined product to a particle size not greater than 100 μm and then metallothermally reducing the product with calcium in a reactor to which access of oxygen is prevented at temperatures of 1,000° to 1,250° C. and an initial pressure of not more than $10^{-3}$ bar at room temperature.

2. The process of claim 1 wherein the CaO is replaced entirely with $CaCO_3$ and the mixture of $Cr_2O_3$, CaO and $CaCO_3$ is calcined at temperatures of 1,000 to 1,200° C., the weight increase being 1 to 6 g of oxygen per mole of $Cr_2O_3$ based on a starting mixture of $Cr_2O_3$/-CaO.

3. The process of claim 2 wherein the oxygen content of the chromium metal powder product is less than 0.1 weight percent.

4. The process of claim 2 wherein the chromium metal product has a particle size not greater than 10 μm.

5. The process of claim 2 wherein the chromium metal product has a particle size not greater than 5 μm.

6. The process of claim 2 wherein the calcined product is mixed with, in relation to the chromium and its average oxidation state, at least equivalent amounts of calcium metal and the mixture is pelletized.

7. The process of claim 2 wherein the calcined product is mixed with, in relation to the chromium and its average oxidation state, at least equivalent amounts of calcined metal and the mixture is compressed into green compacts.

8. The process of claim 2 wherein the calcined product is mixed with, in relation to the chromium and its average oxidation state, at least equivalent amounts of calcium metal, the mixture is pelletized or compressed into green compacts, and the pellets or green compacts are introduced into a chromium crucible which has been evacuated to a pressure of not greater than $10^{-3}$ bar, and the pellets or green compacts are then reduced at a temperature of 1,000° to 1,250° C.

9. The process according to claim 2, wherein the chromium metal product has an average particle size of no greater than about 5 μm.

10. The process according to claim 2, wherein the chromium metal product has an average particle size of about 6.5 μm.

11. The process of claim 1 wherein the oxygen content of the chromium metal powder product is less than 0.1 weight percent.

12. The process of claim 1 wherein the chromium metal product has a particle size not greater than 10 μm.

13. The process of claim 1 wherein the chromium metal product has a particle size not greater than 5 μm.

14. The process of claim 1 wherein the calcined product is mixed with, in relation to the chromium and its average oxidation state, at least equivalent amounts of calcium metal and the mixture is pelletized.

15. The process of claim 1 wherein the calcined product is mixed with, in relation to the chromium and its average oxidation state, at least equivlent amounts of calcium metal and the mixture is compresed into green compacts.

16. The process of claim 1 wherein the calcined product is mixed with, in relation to the chromium and its average oxidation state, at least equivalent amounts of calcium metal, the mixture is pelletized or compressed into green compacts, and the pellets or green compacts are introduced into a chromium crucible which has been evacuated to a pressure of not greater than $10^{-3}$ bar, and the pellets or green compacts are then reduced at a temperature of 1,000° to 1,250° C.

17. The process according to claim 1, wherein the chromium metal product has an average particle size no greater than about 5 μm.

18. The process according to claim 1, wherein the chromium metal prodcut has an average particle size no greater than about 5 μm.

19. The process according to claim 1, wherein the chromium metal product has an average particle size of about 6.5 μm.

20. A process for the preparation of a chromium metal powder having an oxygen content of ≦ 0.1% by weight and an average particle size not greater than 20 μm, comprising calcining a mixture of chromium oxide and $CACO_3$ in a molar ratio of 1:0.5 to 1:2 at temperature between 1,000° C. to 1,200° C., in the presence of oxygen up to a weight increase of 1 to 6 g of oxygen per mole of $Cr_2O_3$ based on a starting mixture of $Cr_2O_3$/-CaO, comminuting the calcined product to a particle size not greater than 100 μm and then metallothermally reducing the product with calcium in a reactor to which access of oxygen is prevented at temperatures of 1,000° to 1,250° C. and an initial pressure of not more than $10^{-3}$ bar at room temperature, and wherein the reaction product obtained from the reduction is comminuted coarsely, the calcined oxide contained in the product is leached by treatment with dilute acids or complexing agents, and the metal power obtained is washed and dried.

21. The process of claim 20 wherein the oxygen content of the chromium metal powder product is less than 0.1 weight percent.

22. The process of claim 20 wherein the chromium metal product has a particle size not greater than 10 μm.

23. The process of claim 20 wherein the chromium metal product has a particle size not greater than 5 μm.

24. The process of claim 20 wherein the calcined product is mixed with, in relation to the chromium and its average oxidation state, at least equivalent amounts of calcium metal and the mixture is pelletized.

25. The process of claim 20 wherein the calcined product is mixed with, in relation to the chromium and its average oxidation state, at least equivalent amounts of calcium metal and the mixture is compressed into green compacts.

26. The process of claim 2 wherein the calcined product is mixed with, in relation to the chromium and its average oxidation state, at least equivalent amounts of calcium metal, the mixture is pelletized or compressed into green compacts, and the pellets or green compacts are introduced into a chromium crucible which has been evacuated to a pressure of not greater than $10^{-3}$ bar, and the pellets or green compacts are then reduced at a temperature of 1,000° to 1,250° C.

27. The process according to claim 20, wherein the chromium metal product has an average particle size of no greater than 15 μm.

28. The process according to claim 20, wherein the chromium metal product has an average particle size no greater than about 5 μm.

29. The process according to claim 20, wherein the chromium metal product has an average particle size of about 6.5 μm.

* * * * *